US007227133B2

(12) United States Patent
Glish et al.

(10) Patent No.: US 7,227,133 B2
(45) Date of Patent: Jun. 5, 2007

(54) METHODS AND APPARATUS FOR ELECTRON OR POSITRON CAPTURE DISSOCIATION

(75) Inventors: Gary L. Glish, Chapel Hill, NC (US); Takashi Baba, Kawagoe (JP)

(73) Assignees: The University of North Carolina at Chapel Hill, Chapel Hill, NC (US); Hitachi, Ltd., Tokyo (JP)

( * ) Notice: Subject to any disclaimer, the term of this patent is extended or adjusted under 35 U.S.C. 154(b) by 16 days.

(21) Appl. No.: 10/453,408

(22) Filed: Jun. 3, 2003

(65) Prior Publication Data

US 2004/0245448 A1 Dec. 9, 2004

(51) Int. Cl.
*H01J 39/34* (2006.01)

(52) U.S. Cl. ..... 250/288; 250/292; 250/293

(58) Field of Classification Search ..... 250/281, 250/288, 289, 309, 287
See application file for complete search history.

(56) References Cited

U.S. PATENT DOCUMENTS 4,867,939 A * 9/1989 Deutch ..... 376/156
4,933,547 A * 6/1990 Cody, Jr. ..... 250/282
5,159,195 A * 10/1992 Van House ..... 250/309
5,340,983 A * 8/1994 Deinzer et al. ..... 250/281
5,572,025 A * 11/1996 Cotter et al. ..... 250/292
5,689,111 A * 11/1997 Dresch et al. ..... 250/287
6,040,575 A 3/2000 Whitehouse et al.
6,593,570 B2 * 7/2003 Li et al. ..... 250/290
6,753,523 B1 * 6/2004 Whitehouse et al. ..... 250/292
6,770,872 B2 * 8/2004 Bateman et al. ..... 250/281
6,919,562 B1 * 7/2005 Whitehouse et al. ..... 250/288
6,958,472 B2 * 10/2005 Zubarev ..... 250/281
2002/0092980 A1 7/2002 Park
2002/0175280 A1 11/2002 Franzen

FOREIGN PATENT DOCUMENTS

WO WO 02 078048 A1 10/2002

OTHER PUBLICATIONS

Greaves, R.G., et al., "Antimatter plasmas and antihydrogen", Phys. Plasmas, vol. 4, No. 5, May 1997: 1528-1543.
Kruger, Nathan A., et al., "Electron capture dissociation of multiply charged peptide cations", International Journal of Mass Spectrometry, 185/186/187, 1999: 787-793.

(Continued)

*Primary Examiner*—David Vanore
(74) *Attorney, Agent, or Firm*—Jenkins, Wilson, Taylor, & Hunt, P.A.

(57) ABSTRACT

The present invention relates to mass spectrometers capable of performing electron (or positron) capture dissociation, methods of performing tandem mass spectrometry, methods of performing electron capture dissociation, and methods of performing positron capture dissociation. In one embodiment, a mass spectrometer capable of performing electron or positron capture dissociation is provided that comprises a first mass analyzer, a magnetic trap downstream of the first mass analyzer, a second mass analyzer downstream of the magnetic trap, and an electron or positron source positioned such that electrons or positrons may be supplied to the magnetic trap.

33 Claims, 8 Drawing Sheets

OTHER PUBLICATIONS

Kruger, Nathan A., et al., "Electron Capture versus energetic dissociation of protein ions", International Journal of Mass Spectrometry, 182/183, 1999: 1-5.

Luca, Alfonz, et al., "On the combination of a linear field free trap with a time-of-flight mass spectrometer", Review of Scientific Instruments, vol. 72, No. 7, Jul. 2001: 2900-2908.

Michael, Steven M., et al., "An ion trap storage/time-of-flight mass spectrometer", Review of Scientific Instruments, vol. 63, No. 10. Oct. 1992: 4277-4284.

Welling, M., et al., "Ion/molecule reactions, mass spectrometry and optical spectroscopy in a linear ion trap", International Journal of Mass Spectrometry and Ion Processes, vol. 172, 1998: 95-114.

Zubarev, Roman A., et al., "Electron Capture Dissociation of Multiply Charged Protein Cations. A Nonergodic Process", J. Am. Chem. Soc., vol. 120, 1998: 3265-3266.

Zubarev, Roman A., et al., "Electron Capture Dissociation for Structural Characterization of Multiply Charged Protein Cations", Anal. Chem., vol. 72, 2000: 563-573.

International Preliminary Report for PCT/US2004/017144 dated Dec. 22, 2005.

* cited by examiner

METHODS AND APPARATUS FOR ELECTRON OR POSITRON CAPTURE DISSOCIATION

FIELD OF THE INVENTION

The present invention generally relates to methods of performing electron or positron capture dissociation and to mass spectrometers capable of performing electron or positron capture dissociation.

BACKGROUND OF THE INVENTION

Mass spectrometry allows the determination of the mass-to-charge ratio (m/z) of ions of sample molecules. Mass spectrometry involves ionizing the sample molecule or molecules and then analyzing the ions in an analyzer that has a detector. Various mass spectrometers are known.

Tandem mass spectrometry involves ionization of a sample into ions, which are introduced into a mass analyzer. The mass analyzer selects parent ions of a desired m/z for further analysis. The parent ions are then fragmented by one or more of a variety of methods into product ions. The product ions are then analyzed by a mass analyzer to determine the mass-to-charge ratios of the product ions and thus obtain a mass spectrum of the product ions. Tandem mass spectrometry has become increasingly important for the analysis of bio-molecules such as peptides and proteins, and enables the determination of amino acid sequence of peptides and proteins.

Fragmentation of parent ions is typically accomplished using collision-induced dissociation (CID), which involves colliding the parent ions with gas atoms or molecules in order to fragment the parent ions. Other methods of fragmenting parent ions are known, such as, for example, electron capture dissociation (ECD). Electron capture dissociation involves the capture of low energy electrons by ions, which leads to the subsequent fragmentation of the ions. Electron capture dissociation produces cleavage patterns of polypeptides that are different than cleavage patterns of polypeptides produced by CID, and the nature of the cleavage patterns makes ECD a desirable fragmentation method for analysis of peptides and proteins by tandem mass spectrometry (see, e.g., Kruger et al., Electron capture dissociation of multiply charged peptide cations, International Journal of Mass Spectrometry, 185–187, 787–793 (1999); Kruger et al., Electron capture versus energetic dissociation of protein ions, International Journal of Mass Spectrometry, 182–183, 1–5 (1999); Zubarev et al., Electron Capture Dissociation of Multiply Charged Protein Cations. A Nonergodic Process, J. Am. Chem. Soc., 120, 3265–3266 (1998); and Zubarev et al., Electron Capture Dissociation for Structural Characterization of Multiply Charged Protein Cations, Anal. Chem., 72, 563–573 (2000)).

Electron capture dissociation is typically performed using a Fourier transform ion cyclotron resonance (FT-ICR) mass spectrometer. Electron capture dissociation is performed in such an instrument by trapping parent ions in the FT-ICR cell and reacting the trapped ions with electrons that are injected into the cell. The product ions that result are also mass analyzed using the FT-ICR cell. Although analysis of peptides and proteins by tandem mass spectrometry using ECD for fragmentation is desirable, the use of ECD has been limited due to both the large size and the expense of FT-ICR mass spectrometers.

SUMMARY OF THE INVENTION

The present invention generally relates to methods of performing electron or positron capture dissociation and to mass spectrometers capable of performing electron or positron capture dissociation. In one aspect of the invention, a mass spectrometer is provided that comprises a first mass analyzer, a magnetic trap downstream of the first mass analyzer, a second mass analyzer downstream of the magnetic trap, and an electron or positron source positioned such that electrons or positrons may be supplied to the magnetic trap.

In another aspect of the invention, a method of performing electron capture dissociation of ions is provided. The method comprises (a) generating electrons using an electron source, (b) confining the electrons to a region within a magnetic trap, and (c) injecting positive ions into the magnetic trap such that electron capture dissociation of at least some of the ions occurs.

In yet another aspect of the invention, a method of performing positron capture dissociation of ions is also provided. The method comprises (a) generating positrons using a positron source, (b) confining the positrons to a region within a magnetic trap, and (c) injecting negative ions into the magnetic trap such that positron capture dissociation of at least some of the ions occurs.

Various methods of performing tandem mass spectrometry using a mass spectrometer comprising a first mass analyzer, a magnetic trap, and a second mass analyzer are provided. One method comprises (a) generating positive sample ions using an ion source, (b) injecting the sample ions into the first mass analyzer, (c) using the first mass analyzer, selecting parent ions from the sample ions to be subjected to electron capture dissociation, (d) injecting the parent ions into the magnetic trap for reaction with electrons confined in the magnetic trap such that electron capture dissociation of at least some of the parent ions occurs to produce product ions, (e) ejecting the product ions from the magnetic trap into the second mass analyzer, and (f) detecting the product ions using the second mass analyzer. Another method comprises (a) generating negative sample ions using an ion source, (b) injecting the sample ions into the first mass analyzer, (c) using the first mass analyzer, selecting parent ions from the sample ions to be subjected to positron capture dissociation, (d) injecting the parent ions into the magnetic trap for reaction with positrons confined in the magnetic trap such that positron capture dissociation of at least some of the parent ions occurs to produce product ions, (e) ejecting the product ions from the magnetic trap into the second mass analyzer, and (f) detecting the product ions using the second mass analyzer.

Yet another method of performing tandem mass spectrometry using a mass spectrometer comprising a first mass analyzer, a magnetic trap, and a second mass analyzer comprises (a) generating positive sample ions using an ion source, (b) injecting the sample ions into the first mass analyzer, (c) using the first mass analyzer, selecting parent ions from the sample ions to be subjected to electron capture dissociation, (d) injecting and confining the parent ions in the magnetic trap, (e) injecting electrons into the magnetic trap for reaction with the confined parent ions such that electron capture dissociation of at least some of the parent ions occurs to produce product ions, (f) ejecting the product ions from the magnetic trap into the second mass analyzer, and (g) detecting the product ions using the second mass analyzer. A further method comprises (a) generating negative sample ions using an ion source, (b) injecting the sample ions into the first mass analyzer, (c) using the first mass analyzer, selecting parent ions from the sample ions to be subjected to positron capture dissociation, (d) injecting and confining the parent ions in the magnetic trap, (e) injecting positrons into the magnetic trap for reaction with the confined parent ions such that positron capture dissociation of at least some of the parent ions occurs to produce product ions, (f) ejecting the product ions from the magnetic trap into the second mass analyzer, and (g) detecting the product ions using the second mass analyzer.

In another aspect of the invention, a mass spectrometer is provided that comprises a first mass analyzer, a field-free region downstream from the first mass analyzer, an electron or positron source positioned such that electrons or positrons may be supplied to the field-free region, and a second mass analyzer downstream of the field-free region.

In yet a further aspect of the invention, a method of performing tandem mass spectrometry using a mass spectrometer comprising a first mass analyzer, a field-free region, an electron source, and a second mass analyzer is provided. The method comprises (a) generating positive sample ions using an ion source, (b) injecting the sample ions into the first mass analyzer, (c) using the first mass analyzer, selecting parent ions from the sample ions to be subjected to electron capture dissociation, (d) providing electrons in the field-free region using the electron source, (e) injecting the parent ions into the field-free region such that electron capture dissociation of at least some of the product ions occurs and such that at least some of the product ions pass into the second mass analyzer, and (f) detecting the product ions using the second mass analyzer.

BRIEF DESCRIPTION OF THE DRAWINGS

FIG. 7 also includes a graph of a possible electric potential along the z axis when both electrons and positive ions are confined in the magnetic trap of the mass spectrometer.

DETAILED DESCRIPTION OF THE INVENTION

Figure 1:
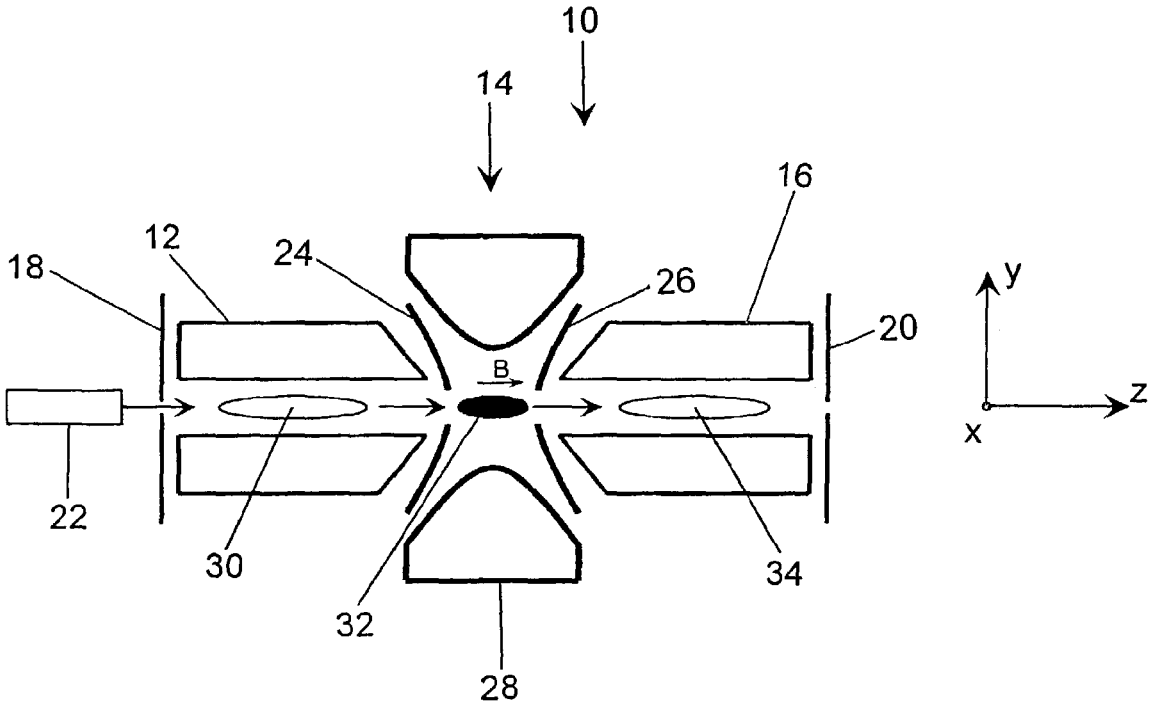
FIG. 1 illustrates one embodiment of a mass spectrometer according to the present invention.

The present invention relates to a mass spectrometer capable of performing electron (or positron) capture dissociation, methods of performing tandem mass spectrometry, methods of performing electron capture dissociation, and methods of performing positron capture dissociation. Prior to describing this invention in further detail, however, the following terms will first be defined.

Definitions:

"Mass analyzer" means any device capable of sorting ions according to their mass-to charge (m/z) ratios. Mass analyzers typically sort ions using electric and/or magnetic fields. Mass analyzers include, but are not limited to, magnetic sectors, linear and three-dimensional quadrupoles (including quadrupole mass filters and quadrupole ion traps), other multipole mass analyzers, Fourier transform ion cyclotron resonance mass spectrometers, and time-of-flight mass analyzers. Mass analyzers may include one or more detectors.

"Detector" means any device capable of detecting ions. Detectors include, but are not limited to, Farady cups, channeltron detectors, electron multipliers, electron photomultipliers, array detectors, and microchannel plates.

"Magnetic trap" means a device having a "ring" electrode, two "end-cap" electrodes each having an opening for passage into the ring electrode, and magnets to produce a magnetic field. In order to trap charged particles, a magnetic trap uses a static electric field (typically a quadrupole field) applied between the end-cap electrodes and the ring electrode to confine charged particles axially (i.e., in the z direction, which is along a z axis between the openings of the end-cap electrodes) and a static magnetic field applied to confine charged particles radially (i.e., in the x and y directions perpendicular to the z axis). The "ring" electrode and the "end-cap" electrodes of a magnetic trap according to the present invention may be in any shape that allows trapping of the desired particles. The magnets of a magnetic trap may be shaped and positioned in any manner that allows the required magnetic field to be applied to confine charged particles radially and allow charged particles to enter and exit the ring electrode through the openings in the end-cap electrodes. The magnets may be separate from the end-cap electrodes or the end-cap electrodes and the magnets may be one and the same (i.e., magnetic end-cap electrodes). When magnetic end-cap electrodes are used, the magnetic trap uses a static electric field applied between the end-cap electrodes and the ring electrode to confine charged particles axially and a static magnetic field applied between the magnetic end-cap electrodes to confine charged particles radially. As used herein, "magnetic trap" and "Penning trap" are synonymous.

"Ideal Penning trap" means a magnetic trap with hyperbolic end-cap and ring electrodes where the ring electrode has a central inner radius of $r_0$ and the end-cap electrodes are separated by a distance of $\sqrt{2}r_0$. An ideal Penning trap has a uniform magnetic field (B) applied in the z direction (i.e., (0, 0, B)) and an ideal quadrupole DC potential ($\psi$).

"Axial direction" or "z direction" means a direction along a "z axis" formed by the centers of the openings of the end-cap electrodes of a magnetic trap.

"Radial direction", "x direction", or "y direction" means a direction perpendicular to the "axial direction" or the "z axis" formed by the center of the openings of the end-cap electrodes of a magnetic trap.

"Parent ion" means, with respect to tandem mass spectrometry, the ion or ions that is/are selected to be dissociated into fragments using a method such as electron capture dissociation.

"Product ion" means, with respect to tandem mass spectrometry, the ion or ions that is/are produced from dissociating parent ions.

Electron (or positron) capture dissociation may be performed according to the present invention by confining electrons (or positrons) to a region within a magnetic trap and injecting oppositely charged ions into the magnetic trap such that electron (or positron) capture dissociation of at least some of the ions occurs via reaction of ions with the confined electrons (or positrons). The oppositely charged ions are preferably multiply charged ions (i.e., the ions preferably have a charge state of 2 or more).

In one aspect of the invention, a mass spectrometer capable of performing electron or positron capture dissociation is provided that comprises a first mass analyzer, a magnetic trap, and a second mass analyzer. The magnetic trap functions as an electron capture dissociation cell or as a positron capture dissociation cell during operation of the mass spectrometer. That is, the magnetic trap acts to confine electrons or positrons for reaction with oppositely charged ions that are injected into the trap from one mass analyzer toward the other mass analyzer.

The first mass analyzer, magnetic trap, and second mass analyzer are arranged such that ions may move from the first mass analyzer to the magnetic trap and from the magnetic trap to the second mass analyzer. That is, the first mass analyzer, magnetic trap, and second mass analyzer are arranged in series (linear or otherwise). The mass spectrometer may consist only of the first mass analyzer, the magnetic trap, and the second mass analyzer, or may include other elements (such as, for example, one or more skimmers, ion guides, detectors, vacuum pumps, additional mass analyzers, etc.) before, after, between, and in addition to the first mass analyzer, the magnetic trap, and the second mass analyzer. As used herein, "downstream" means in a direction from the first mass analyzer to the magnetic trap to the second mass analyzer, and "upstream" means in a direction from the second mass analyzer to the magnetic trap to the first mass analyzer. As explained below, appropriate DC and/or AC (e.g., RF) voltages and magnetic fields are applied to the mass analyzers and magnetic trap (using means for supplying voltages and magnetic fields that are part of the mass analyzers, magnetic trap and/or mass spectrometer such as, for example, voltage supplies and magnets) in order to manipulate charged particles in the mass spectrometer.

The magnetic trap includes permanent magnets or electromagnets that may or may not be superconducting. In a preferred embodiment, the magnets are permanent magnets. The magnetic field strength (B) of the magnetic trap is typically larger than 0.5 T, but may be of any field strength that is sufficient for the particular embodiment.

The voltage range used with the first and second mass analyzers and the magnetic trap will depend on the particular analyzers and magnetic trap being used as well as the particular embodiment of the mass spectrometer. For example, quadrupole and ion trap mass analyzers are typically operated using voltages in the range of 1–100 eV while sectors and time-of-flight mass analyzers are typically operated using voltages in the range of 1–10 keV. The magnetic trap is typically operated in a voltage range of 1–100 eV. However, it should be noted that the mass analyzers and the magnetic trap may be operated using any voltage or voltage range appropriate for the particular embodiment in which they are being used.

The mass spectrometer typically includes an ion source to supply ions to the first mass analyzer, although the ion source may be external to (i.e., not a part of) the mass spectrometer. Ions may be supplied using ion sources that use electrospray ionization (ESI), nanoelectrospray ionization (nESI), matrix assisted laser desorption ionization (MALDI), electron impact ionization (EI) or any other method for producing ions. The ion flow in the mass spectrometer is typically from an ion source to the first mass analyzer, from the first mass analyzer to the magnetic trap, and from the magnetic trap to the second mass analyzer. In some embodiments, however, it may be desirable for ions to be directed from the second mass analyzer back through the magnetic trap to the first mass analyzer and, if desired, again through the magnetic trap to the second mass analyzer. In some embodiments, ions may be passed through the magnetic trap between the first and second mass analyzers multiple times.

Charged particles (e.g., ions and electrons) may be manipulated during operation of the mass spectrometer by modifying the electric and/or magnetic fields of one or more of the mass analyzers, magnetic trap, or, when present, other elements of the mass spectrometer. Such manipulation may be associated with injecting, trapping, sorting, or ejecting ions from the first or second mass analyzers, reversing the ion flow from downstream to upstream and from upstream to downstream (e.g., to pass ions through the magnetic trap multiple times), and/or injecting, trapping, or ejecting electrons from the magnetic trap. Modification of the electric and/or magnetic fields of one or more of the mass analyzers or magnetic trap in order to manipulate charged particles in the mass spectrometer will depend on the specific mass analyzers and magnetic trap being used with the mass spectrometer as well as the specific arrangement of the mass analyzers, the magnetic trap, and any other elements of the mass spectrometer.

The mass spectrometer also typically includes an electron source (when performing electron capture dissociation) or a positron source (when performing positron capture dissociation), although the electron or positron source may also be external to (i.e., not a part of) the mass spectrometer. Whether part of the mass spectrometer or not, the electron (or positron) source is positioned with respect to the magnetic trap such that electrons (or positrons) may be supplied to the magnetic trap when desired. The electron (or positron) source may be positioned inside or outside of the magnetic trap. Examples of electron sources include, but are not limited to, a thermal electron source (e.g., a tungsten filament) that may or may not be covered with a substance that provides a low work function (e.g., barium oxide (BaO)). In one embodiment, the electron source is a mesh electron source that allows the passage of ions through the mesh. Examples of positron sources include, but are not limited to, radioactive sources such as, for example, $^{22}$Na isotope with thermalizers.

The first and second mass analyzers may be different types of mass analyzers or the same type of mass analyzer. For example, the first mass analyzer could be a quadrupole ion trap and the second mass analyzer could be a quadrupole mass filter, or both the first mass analyzer and the second mass analyzer could be quadrupole ion traps. The first mass analyzer and the second mass analyzer may be operated to sort, guide, trap, etc. ions in a broad mass-to-charge ratio (m/z) range or a narrow m/z range. In addition, one or more of the first mass analyzer, the magnetic trap, and the second mass analyzer may be positioned within one or more enclosures with pumps to provide operating conditions with reduced pressure (e.g., a vacuum). Various embodiments using different types of mass analyzers are explained below.

The present invention also includes methods of performing tandem mass spectrometry using a mass spectrometer as described above comprising a first mass analyzer, a magnetic trap, and a second mass analyzer. Ions are generated using an ion source and are injected into the first mass analyzer. Parent ions to be subjected to electron (or positron) capture dissociation are selected using the first mass analyzer. The parent ions are subjected to electron (or positron) capture dissociation to produce product ions by injecting the parent ions into the magnetic trap and allowing the parent ions to react with electrons (or positrons) trapped in the magnetic trap. The electrons (or positrons) are preferably trapped in the magnetic trap before the parent ions are injected into the magnetic trap, but may be trapped in the magnetic trap anytime before or during injection of the parent ions into the magnetic trap. The electrons (or positrons) may also be trapped in the magnetic trap before, during, or after injection of ions from the ion source into the first mass analyzer. After electron (or positron) capture dissociation produces product ions from at least some of the parent ions, the product ions are ejected from the magnetic trap into the second mass analyzer, and the product ions are detected using the second mass analyzer or another mass analyzer that is part of the mass spectrometer and that includes a detector. As mentioned above, the charged particles (i.e., ions and electrons) are manipulated during the method using appropriate voltages and magnetic fields to the mass analyzers and magnetic trap.

Illustrative Embodiments of Mass Spectrometer Having a Magnetic Trap

Various embodiments of a mass spectrometer comprising a first mass analyzer, a magnetic trap, and a second mass analyzer are possible. As stated above, the first and second mass analyzers may be different types of mass analyzers or the same type of mass analyzer. Three illustrative embodiments are described below with respect to electron capture dissociation and are intended to be non-limiting.

Embodiment of FIG. 1

FIG. 1 illustrates one embodiment of a mass spectrometer 10 according to the present invention. The mass spectrometer 10 includes a first linear quadrupole 12 as a first mass analyzer, a magnetic trap 14 (which may be an ideal Penning trap), a second linear quadrupole 16 as a second mass analyzer, a first ion gate 18, a second ion gate 20, and an ion source 22.

The magnetic trap 14 includes end-cap electrodes 24, 26 and ring electrode 28. The end-cap electrodes 24, 26 are magnets and are used as the source of a magnetic field (B). The end-cap electrodes 24, 26 are also used, along with the ring electrode 28, as electrodes to generate a quadrupole electric field (a static voltage is applied between the end-cap electrodes 24, 26 and the ring electrode 28).

As illustrated in the figure, the first mass analyzer 12, the magnetic trap 14, and the second mass analyzer 16 are arranged coaxially along the axis of the center of the quadrupoles and the center of the openings of the end-cap electrodes of the magnetic trap 14. The arrows in the figure illustrate the typical direction of ions through the mass spectrometer 10.

In operation of the mass spectrometer 10 of FIG. 1, ions are produced by ion source 22 and are injected through ion gate 18 into linear quadrupole 12. The linear quadrupole 12 is used to select parent ions 30 in a specified m/z range. The parent ions 30 are injected from the linear quadrupole 12 into the magnetic trap 14, which contains trapped electrons 32. The electrons 32 are trapped before injection of the parent ions into the magnetic trap 14. At least some of the parent ions 30 react with the electrons 32 and undergo electron capture dissociation to produce product ions 34. The product ions 34 and any remaining parent ions are ejected from magnetic trap 14 into linear quadrupole 16.

The linear quadrupoles 12, 16 may be linear radio-frequency quadrupoles and may be operated as linear quadrupole mass filters or linear quadrupole ion traps, and appropriate voltages may be applied to operate the mass spectrometer 10 accordingly. Also, the voltages of the linear quadrupoles 12, 16, the ion gates 18, 22, and/or the magnetic trap 14 may be modified during operation of the mass spectrometer 10 to manipulate the ions or electrons.

In one more specific embodiment of the mass spectrometer 10 of FIG. 1, the first linear quadrupole 12 could be operated as a quadrupole mass filter and the second linear quadrupole 16 could be operated as a linear quadrupole ion trap. In such an embodiment, the quadrupole mass filter could be used to select parent ions having a specified m/z range and the quadrupole ion trap 16 could be used to trap product ions within a specified m/z range. The parent ions passing through the magnetic trap 14 without reacting with the electrons 32 could be injected back into the magnetic trap 14 for fragmentation using electron capture dissociation, and parent and/or product ions passing into the first mass analyzer could be again passed through the magnetic trap 14 and into the ion trap 16. During such a process, the ion gates 18, 20 could be used to generate a potential to trap parent and product ions within the mass spectrometer 10. The product ions 34 could eventually be detected by a suitable detector to produce a mass spectrum.

Figure 2:
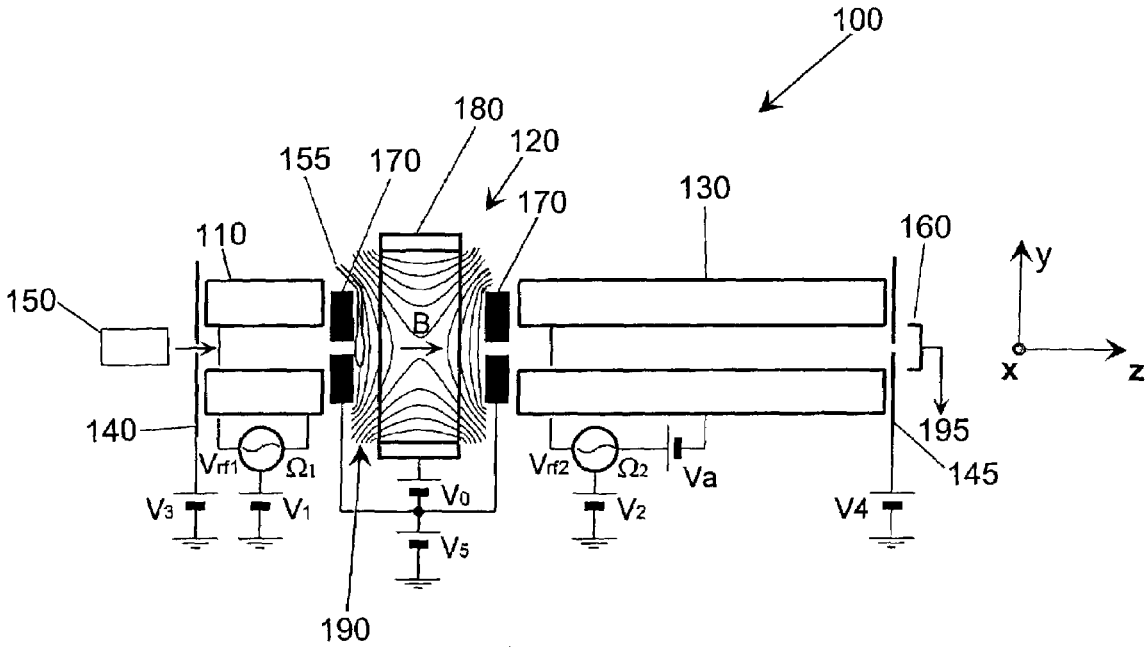
FIG. 2 illustrates another embodiment of a mass spectrometer according to the present invention.

Embodiment of FIG. 2

FIG. 2 illustrates another embodiment of a mass spectrometer 100 according to the present invention. The mass spectrometer 100 includes a linear radio frequency quadrupole ion trap 110 as a first mass analyzer, a magnetic trap 120, a linear radio frequency quadrupole mass filter 130 as a second mass analyzer, ion gates 140, 145, an ion source 150, an electron source 155, and a detector 160. As shown in the figure, the ion trap 110, the magnetic trap 120, and the quadrupole mass filter 130 are arranged coaxially.

The magnetic trap 120 includes permanent magnets 170 and a ring electrode 180 in the shape of a cylinder. The magnetic trap 120 also includes a magnetic flux return yoke, which is not shown in the figure. The magnets 170 are used as the source of a magnetic field and are used, along with the ring electrode 120, as electrodes to generate a quadrupole electric field. As shown in the figure, a static voltage (i.e., $V_0$) is applied between the magnets and the ring electrode. The distance between the two magnets is preferably $\sqrt{2}r_0$, which will provide a quadrupole field inside the trap, as illustrated by the electric potential lines 190 shown in the figure. The electron source 155 shown beside one of the magnets 170 in FIG. 2 could be a thermal electron source such as, for example, a tungsten filament. The electron energy could be controlled by the potential of the filament (i.e., $V_f$).

The first mass analyzer 110 is a linear radio frequency quadrupole ion trap made of four cylindrical rods. A static voltage $V_1$ and a radio frequency voltage $V_{rf1}$ with a frequency of $\Omega_1$ are applied to the first mass analyzer 110 to establish a quadrupole electric field. The second mass analyzer 130 is a linear quadrupole mass filter also made of four cylindrical rods. A static voltage $V_2$ and a radio frequency voltage $V_{rf2}$ with a frequency of $\Omega_2$ are applied to the second mass analyzer 130 to establish a quadrupole electric field. The quadrupole fields of the mass analyzers 110, 130 are used to radially (i.e., in the x and y directions) confine ions of a selected m/z range within the mass analyzers. Static voltage $V_a$ is applied to control the width of the selected m/z range. The linear quadrupole ion trap 110 also confines ions axially (i.e., along the z direction) using static voltages $V_3$ and $V_5$ applied to ion gate 140 and the end-cap electrodes 170, respectively.

In operation of the mass spectrometer of FIG. 2, ions are produced by ion source 150 and enter the linear radio frequency quadrupole ion trap 110 through ion gate 140. The ions are trapped in the ion trap 110 by the axial confining potential created by static voltages $V_3$ and $V_5$ and by the radial confining potential created by voltages $V_1$ and $V_{rf1}$. The ion trap 110 may be used to select parent ions within a specified m/z range. The parent ions are injected into the magnetic trap 120, which contains trapped electrons from electron source 155.

The electrons in the magnetic trap 120 are trapped prior to injection of the parent ions into the magnetic trap 120. The electrons are confined axially by the static potential created by the application of $V_0$ between the end-cap electrodes 170 and the ring electrode 180 and are confined radially by the magnetic field (B) created between the two end-cap magnets 170.

At least some of the parent ions react with the trapped electrons in the magnetic trap 120 and are dissociated into product ions via electron capture dissociation. The product ions and any remaining parent ions are ejected from the magnetic trap 120 into the quadrupole mass filter 130, which may be used to select ions in a specified m/z range and guide those ions toward the static voltage $V_4$ of ion gate 145. The ions pass through the ion gate 145 to detector 160 where the ions are detected and a signal 195 is generated to produce a mass spectrum (not shown).

In one particular embodiment of the mass spectrometer 100 shown in FIG. 2, the magnetic trap 120 has a ring electrode 180 in the shape of a cylinder with an internal radius (i.e., $r_0$) of 21.3 mm and end-cap electrodes 170 that are permanent magnets with 1.3 T (e.g., NEO-MAX, Sumitomo Special Metals). The linear radio frequency quadrupole ion trap 110 may be made from four cylindrical rods with a diameter of 15.4 mm and a length of 70 mm, with the distance between the center axis to a rod surface being 6.7 mm. The linear radio frequency quadrupole mass filter 130 could be made from four cylindrical rods with a diameter of 15.4 mm and a length of 224 mm, with the distance between the center axis to a rod surface being 6.7 mm. In such an embodiment, an RF voltage with a frequency of 1.3 MHz could be applied to the linear radio frequency quadrupole ion trap 110 and a RF voltage with a frequency of 1.0 MHz could be applied to the linear radio frequency quadrupole mass filter 130.

Figure 3:
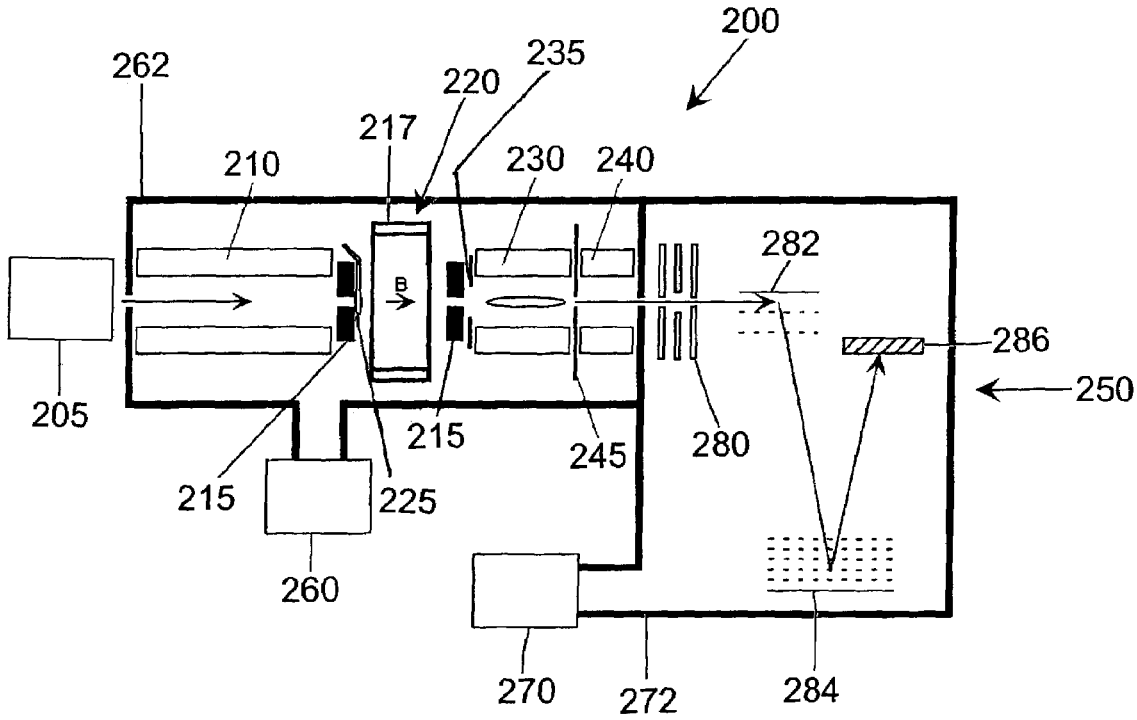
FIG. 3 illustrates a further embodiment of a mass spectrometer according to the present invention.

Embodiment of FIG. 3

FIG. 3 illustrates another embodiment of a mass spectrometer according to the present invention. The mass spectrometer 200 includes an ionization source 205, a linear quadrupole mass filter 210, a Penning trap 220, an electron source 225, a linear quadrupole ion trap 230, a gate 235, an ion guide 240, a second gate 245, and a time-of-flight mass analyzer 250. The mass spectrometer 200 includes a pump 260 for operating the quadrupole mass filter 210, the Penning trap 220, the linear quadrupole ion trap 230, and the ion guide 240 under reduced pressure (e.g., in a vacuum) in enclosure 262. The mass spectrometer 200 also includes a pump 270 for operating the time-of-flight analyzer 250 at a reduced pressure (e.g., in a vacuum) in enclosure 272. The magnetic ion trap 220 includes magnetic end-cap electrodes 215 and ring electrode 217. The time-of-flight mass analyzer 250 includes lens 280, pusher 282, reflectron 284, and microchannel plate detector 286. Arrows in FIG. 3 show the direction of ions into the quadrupole mass filter 210 as well as from ion guide 240 through the time-of-flight mass analyzer 250.

In operation of the mass spectrometer of FIG. 3, ions are produced by ion source 205 and are injected into the linear quadrupole mass filter 210. The quadrupole mass filter 210 may be used to select parent ions within a specified m/z range. The parent ions are injected into the magnetic trap 220, which contains trapped electrons from electron source 225. The electrons in the magnetic trap 220 are trapped prior to injection of the parent ions into the magnetic trap 220. At least some of the parent ions react with the trapped electrons in the magnetic trap 220 and are dissociated into product ions via electron capture dissociation. The product ions and any remaining parent ions are ejected from the magnetic trap 220 into the linear quadrupole ion trap 230, which includes gates 235 and 245. The selected ions pass through the ion guide 240 to the time-of-flight mass analyzer 250, where the ions are detected by the microchannel plate detector 286.

Electron Capture Dissociation in an Ideal Penning Trap

In order to further explain the present invention, various aspects of electron capture dissociation in an ideal Penning trap are theoretically described below.

Electron capture dissociation can be represented by the following equation (1), $$M^{+Q}+e^{-}=m^{+q}+(M-m)^{Q-q-1}+K_p+k_p \tag{1}$$

where a parent ion having a mass of M and charge of +Q reacts with an electron having a mass of $m_e$ and a charge of −1. Product ions are produced that have masses of m and (M−m) and charges of +q and Q−q−1, respectively. The reaction releases energy $K_p+k_p$. $K_p$ and $k_p$ represent the kinetic energy of the ion $m^{+q}$ and the ion $(M-m)^{Q-q-1}$, respectively, at an infinite distance from each other.

Cross Section of Electron Capture Dissociation

The typical reaction cross section of electron capture dissociation (i.e., $\sigma_{ECD}$) is $10^{-15}$ $m^2$ for electrons with ~1 eV (see, e.g., Zubarev et al., Electron Capture Dissociation for Structural Characterization of Multiply Charged Protein Cations, Anal. Chem., 72, 563–573 (2000)). Using the cross section, reaction probability (i.e., $r_{ECD}$) is given by the following equation (2)

$$r_{ECD}=1-\exp(-\sigma_{ECD}\rho\Delta t v_e) \tag{2}$$

where ρ is the density of the electrons, $v_e$ is the velocity of electrons, and Δt is the interaction time (i.e., the period that a parent ion locates between one end cap and another end cap). In deriving equation (2), it was assumed that the velocity of the electrons is much larger than the velocity of the parent ions. As illustrated by equation (2), a large electron density and a large interaction time are required to obtain a large reaction probability.

The reaction energy of electron capture dissociation (i.e., $K_{react}$) does not depend on the kinetic energy of the parent ions (i.e., K) in the laboratory system. When the kinetic energy of a parent ion (i.e., K) and the kinetic energy of the electron (i.e., $K_e$) are approximately equal (i.e., when $K \sim K_e$), the reaction energy (i.e., $K_{react}$) is equal to the electron kinetic energy as shown by the following approximation, $$K_{react} = K_e - 2\sqrt{\frac{m_e}{m}K_e K} \sim K_e. \tag{3}$$

This means that the reaction energy (i.e., $K_{react}$) should be able to be controlled by the kinetic energy (or temperature) of the electrons used in the electron capture dissociation reaction.

Equation of Motions

Equations (4), (5), and (6) below describe the motion of a charged particle with mass of m and charge of q in an ideal Penning trap (i.e., in a Penning trap that has a uniform magnetic field applied to the z direction, (0, 0, B), and an ideal quadrupole DC potential, $\psi = V_0(x^2+y^2-2z^2)/2r_0^2$). The equations can be used to describe the motion of electrons as well as parent and product ions in an ideal Penning trap.

$$m\frac{d^2}{dt^2}x = qv_yB - qV_0\frac{x}{r_0^2} \tag{4}$$

$$m\frac{d^2}{dt^2}y = -qv_xB - qV_0\frac{y}{r_0^2} \tag{5}$$

$$m\frac{d^2}{dt^2}z = qV_0\frac{2z}{r_0^2} \tag{6}$$

where $r_0$ represents the central internal radius of the ring electrode, B represents the magnetic field strength, $(v_x, v_y, v_z)$ represents the velocity of the charged particle and x, y, and z represent the position of the charged particle in the x, y, and z directions, with the coordinate z=0, x=0, y=0 being at the center of the Penning trap along the z axis formed by the apertures in the end-caps.

Electron storage

The maximum density of electrons in the Penning trap may be estimated when the DC voltage (i.e., $V_0$) of the Penning trap satisfies the stability condition of the Penning trap (i.e., the magnetron motion stability), which is given by Equation 7:

$$V_0 \le \frac{eB^2}{4m_e r_0^2} \tag{7}$$

where e and $m_e$ represent the charge and the mass, respectively, of an electron. This condition should be satisfied under typical operating conditions. For example, this condition would be satisfied if $V_0$=10 V, $r_0$=21.3 mm, and B=1.3 T, because 10 V is smaller than the right hand side of equation (7), which is ~1 kV.

If the stability condition is satisfied, the maximum electron density in the Penning trap (i.e., ρ) is given by the lower value of the following two categories: (1) Brillouin condition, which is a balance of the repulsive Coulomb force between charges and a rotating force in the magnetic field and is represented by Equation (8) below and (2) the space charge limit density in a confinement potential (when it is assumed that a space charge is an infinitely long cylinder of uniform density), which is represented by equation (9) below:

$$\rho = \epsilon_0\frac{eB^2}{2m_e} \tag{8}$$

where $\epsilon_0$ is the dielectric constant of vacuum, $$\rho = 2\epsilon_0\frac{V_0}{r_0^2}. \tag{9}$$

When $V_0$=10 V, $r_0$=21.3 mm, and B=1.3 T, the maximum density is given by equation (9) because the value of equation (9) is much smaller than the value given by the Brillouin condition, equation (8).

Figure 4:
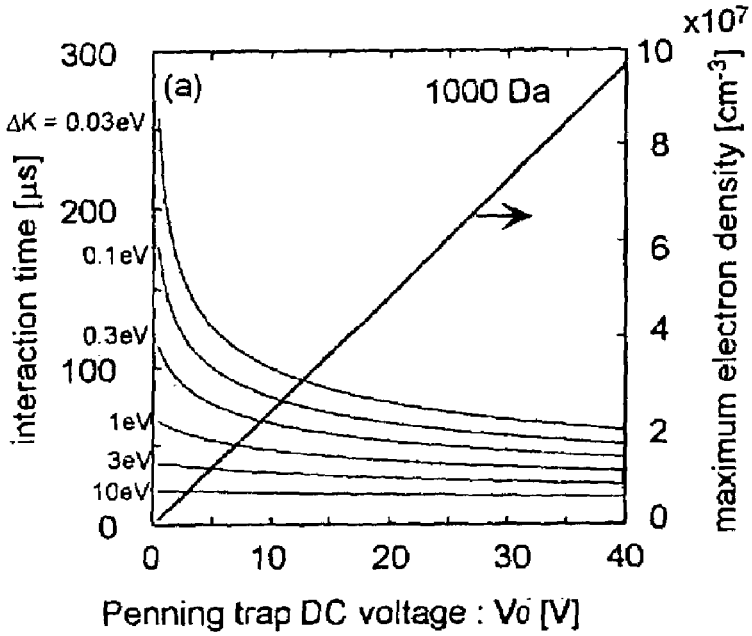
FIG. 4 is a graph of Penning trap DC voltage ($V_0$) versus interaction time of a parent ion having a mass-to-charge ratio of 1000. The graph also illustrates the effect of Penning trap DC voltages on electron density in a Penning trap.

FIG. 4 includes a plot of maximum electron density in a Penning trap under varying voltages. The maximum electron density is shown by the thick line in the FIG. 4 and was calculated using Equation (9). As shown in the figure, the maximum electron density depends linearly on $V_0$.

Interaction Time

The reaction efficiency of electron capture dissociation depends on the interaction time (i.e., Δt) of the parent ion, which is obtained by solving the equation of motion, equation (6), and is given below as Equation (10):

$$\Delta t = \sqrt{\frac{2mr_0^2}{qV_0}}\sinh^{-1}\sqrt{\frac{qV_0}{2\Delta K}} \tag{10}$$

where ΔK (i.e., the kinetic energy of the parent ion at z=0) is equal to $K_i - V_0/2$, with $K_i$ being the kinetic energy of the parent ion at the end cap electrodes.

In the estimation of the interaction time in equation (10), the existence of electrons in the Penning trap was ignored. When electrons are stored in the Penning trap, the static potential along the z axis (i.e., the axis between the center of the apertures in the end-cap electrodes) is lowered by the space charge of the electrons, which results in a larger interaction time than the above estimation.

As shown in FIG. 4, equation (10) was used to plot Penning trap DC voltage (i.e., $V_0$) versus interaction time of a parent ion with a mass-to-charge ratio (i.e., m/z) of 1000 Da (represented by the thin lines on FIG. 4). The following values were chosen for ΔK, with each value shown next to the appropriate line in FIG. 4: 0.03 eV, 0.1 eV, 0.3 eV, 1 eV, 3 eV, and 10 eV. As illustrated in FIG. 4, a relatively small $V_0$ and small ΔK give a relatively large interaction time.

Reaction Probability

Figure 5:
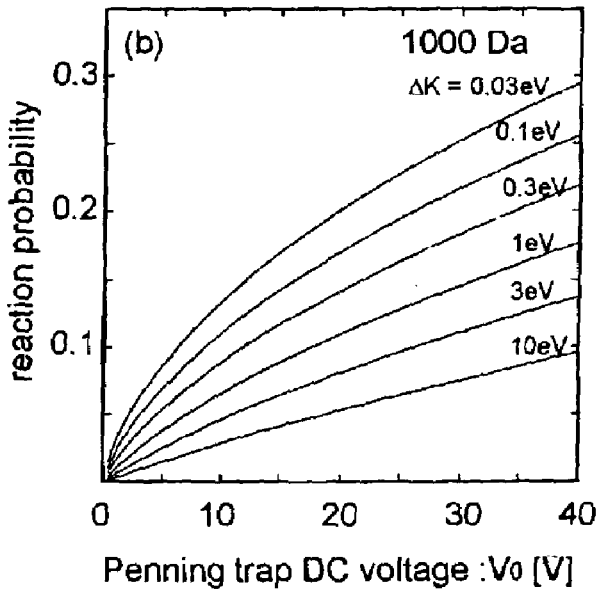
FIG. 5 is a graph of Penning trap DC voltage ($V_0$) versus reaction probability of a parent ion with a mass-to-charge ratio of 1000.

FIG. 5 shows a plot of reaction probability calculated using equation (2). In calculating the graph, the mass-to-charge ratio of the parent ions was fixed to 1000 Da and the following values were used for the kinetic energy of the parent ions at z=0 (i.e., ΔK): 0.03 eV, 0.1 eV, 0.3 eV, 1 eV, 3 eV, and 10 eV. In addition, the kinetic energy of the electrons was fixed to 1 eV.

As shown in FIG. 5, in order to obtain a large reaction probability, $V_0$ should be large and ΔK should be small. When ΔK=0.1 eV and $V_0$=20 eV, the reaction probability is about 20%.

As discussed above, parent ions could be passed through the electrons trapped in the Penning trap several times in order to increase the reaction probability.

Ejection of Product Ions

The ejection efficiencies of product ions of varying mass-to-charge ratios (m/z) from the magnetic trap were calculated by Monte Carlo simulation using the equations of motion (i.e., equations (4)–(6)). The electron capture dissociation reaction of the parent ion was set to occur on the z axis. The reaction point on the z axis (i.e., $z_0$) and the velocity (i.e., $v_0$) of a parent ion are given by the solution of the equation of motion (i.e., equation (6)) and are shown below as equations (11) and (12), respectively:

$$z_0 = \sqrt{\frac{\Delta K}{qV_0}}\, r_0 \sinh\sqrt{\frac{2qV_0}{mr_0^2}}\, t \tag{11}$$

$$v_0 = \sqrt{\frac{2\Delta K}{m}} \cosh\sqrt{\frac{2qV_0}{mr_0^2}}\, t \tag{12}$$

where t is given randomly with a constraint of $[z_0]<r_0/\sqrt{2}$. The product ion was approximated to have kinetic energy $K_p$ plus kinetic energy of the parent ion that reacts with the electron. In order to account for the kinetic energy of the parent ion, a velocity with a speed $\sqrt{2K_p/m}$ and a spherically random direction was added to the velocity of the parent ion (i.e., $v_0$). When the product ion reaches one of the holes on the two end cap electrodes, the ion was judged to be ejected from the magnetic trap. The ejection efficiency was defined as a ratio of ejected events when 10,000 events were shot for Monte Carlo simulation.

Figure 6:
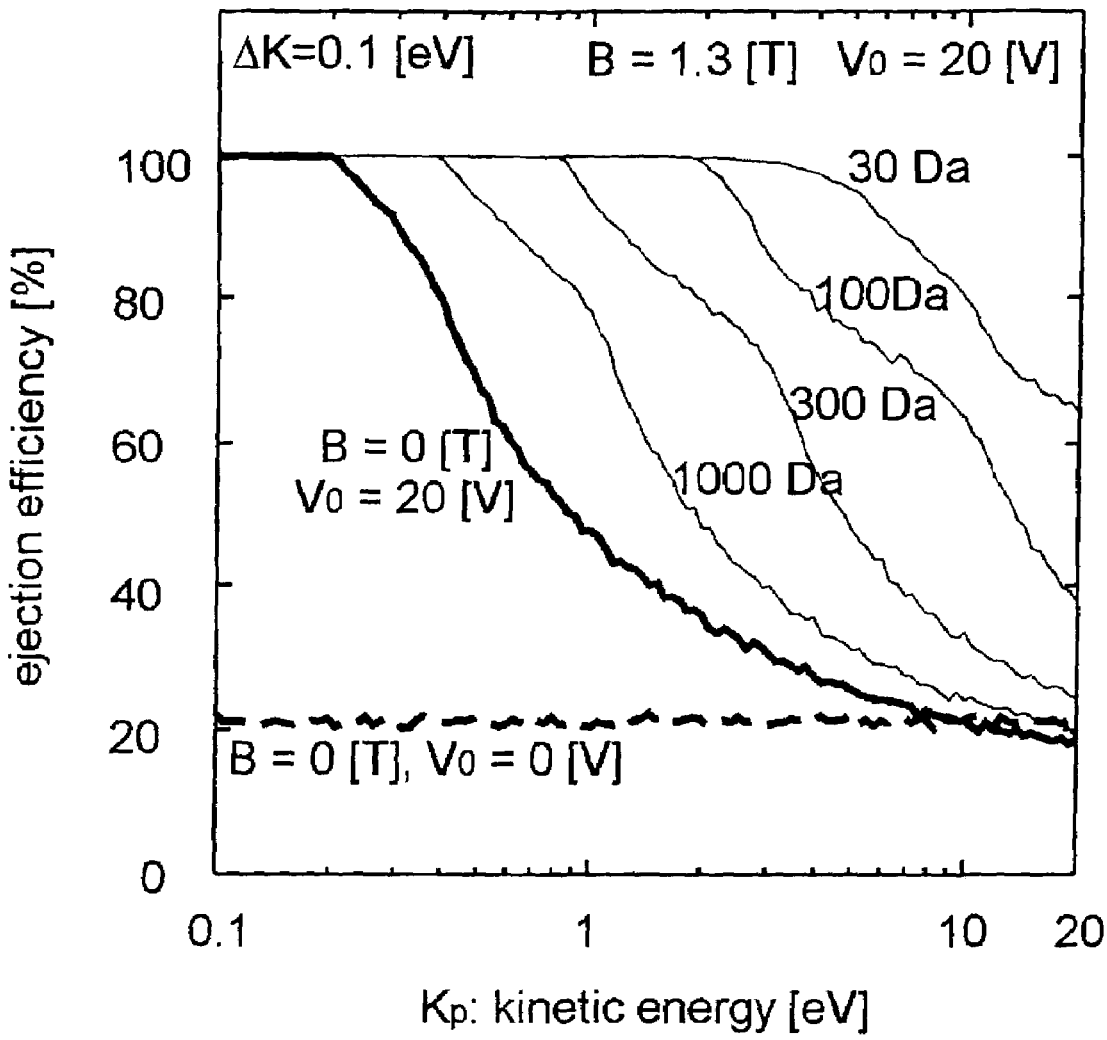
FIG. 6 is a graph of kinetic energy of product ions versus ejection efficiency of the product ions from the Penning trap. The thick dashed line represents ejection efficiency of the product ions when there is no field in the Penning trap (i.e., B=0 and $V_0$=0). The thick solid line represents the ejection efficiency of the product ions when $V_0$=20 Volts (V) and B=0 Tesla (T). The thin lines represent the ejection efficiencies of product ions of varying mass-to-charge ratios when B=1.3 Tesla (T) and $V_0$=20 V.

FIG. 6 illustrates a graph of kinetic energy of product ions (i.e., $K_p$) versus ejection efficiency of the product ions from the Penning trap as calculated using Monte Carlo simulation. The kinetic energy of the parent ions at z=0 (i.e., ΔK) was fixed to 0.1 [eV] and the Penning trap static voltage (i.e., $V_0$) was fixed to 20 Volts. As discussed above, the kinetic energy of the product ions (i.e., $K_p$) depends on the reaction.

When there is no electromagnetic field in the Penning trap (i.e., B=0 and $V_0$=0), the ejection efficiency of the product ions is given by the solid angle of the hole. The thick dashed line in FIG. 6 represents ejection efficiency of product ions when there is no field in the Penning trap.

As shown by the thick solid line in FIG. 6, applying a static DC voltage of 20 V to the Penning trap (i.e., $V_0$) in the absence of a magnetic field (i.e., B=0) enhances the ejection efficiency of product ions when $K_p$ is small as compared to the ejection efficiency of product ions in no field at all. This is because the quadrupole static field focuses the ions in the radial direction as well as forces the ions along the z axis.

When the Penning trap has no magnetic field (i.e., B=0), the ejection efficiency of product ions is less dependent on the mass of the product ions than when there is a magnetic field present in the Penning trap.

As shown in FIG. 6, the thin lines represent the mass dependence of the ejection efficiencies when B=1.3 T and $V_0$=20 V for product ions having masses of 30, 100, 300, and 1000 Da. The magnetic field enhances the ejection efficiency because the magnetic field traps the ions radially along the z direction and the trajectory of the ions are spiral along the z direction. As can be seen in the figure, the magnetic field is more effective for ions with less mass. This is because the cyclotron radius of product ions is inversely proportional to the mass-to-charge ratio. Therefore, stronger magnetic fields will provide higher ejection efficiencies of product ions.

The mass spectrometer described above may also include additional trapping electrodes adjacent to the ring electrode of the magnetic trap either inside of the end-cap electrodes of the Penning trap (such that the additional trapping electrodes are between the end-cap electrodes and the ring electrode) or outside of the end-cap electrodes of the Penning trap (such that each end-cap electrode is between each additional trapping electrode and the ring electrode). Such additional trapping electrodes could be used, in conjunction with the magnetic trap, to trap both electrons and positively charged ions in the magnetic trap for electron capture dissociation or to trap both positrons and negatively charged ions in the magnetic trap for positron capture dissociation. After electron (or positron) capture dissociation of the ions, appropriate voltages to the magnetic trap, the additional trapping electrodes, and/or other elements of the mass spectrometer could be used to manipulate the product ions (e.g., to eject the product ions from the magnetic trap and into the second mass analyzer). The additional trapping electrodes could be in any form and could be, for example, plate electrodes with apertures or mesh electrodes.

When the mass spectrometer includes additional trapping electrodes such that oppositely charged particles (e.g., electrons and positively-charged ions) may be trapped in the Penning trap, the ions to be subjected to electron (or positron) capture dissociation may be injected into the magnetic trap either before, after, or during loading of electrons (or positrons) into the magnetic trap. After electron (or positron) capture dissociation, appropriate voltages may be applied to the additional trapping electrodes, the magnetic trap, and/or the first or second mass analyzers ion order to eject the product ions from the magnetic trap into either the first or the second mass analyzer. The product ions may then be analyzed in an area separate from the electron (or positron) capture dissociation cell (e.g., in order to produce a tandem mass spectrum).

Figure 7:
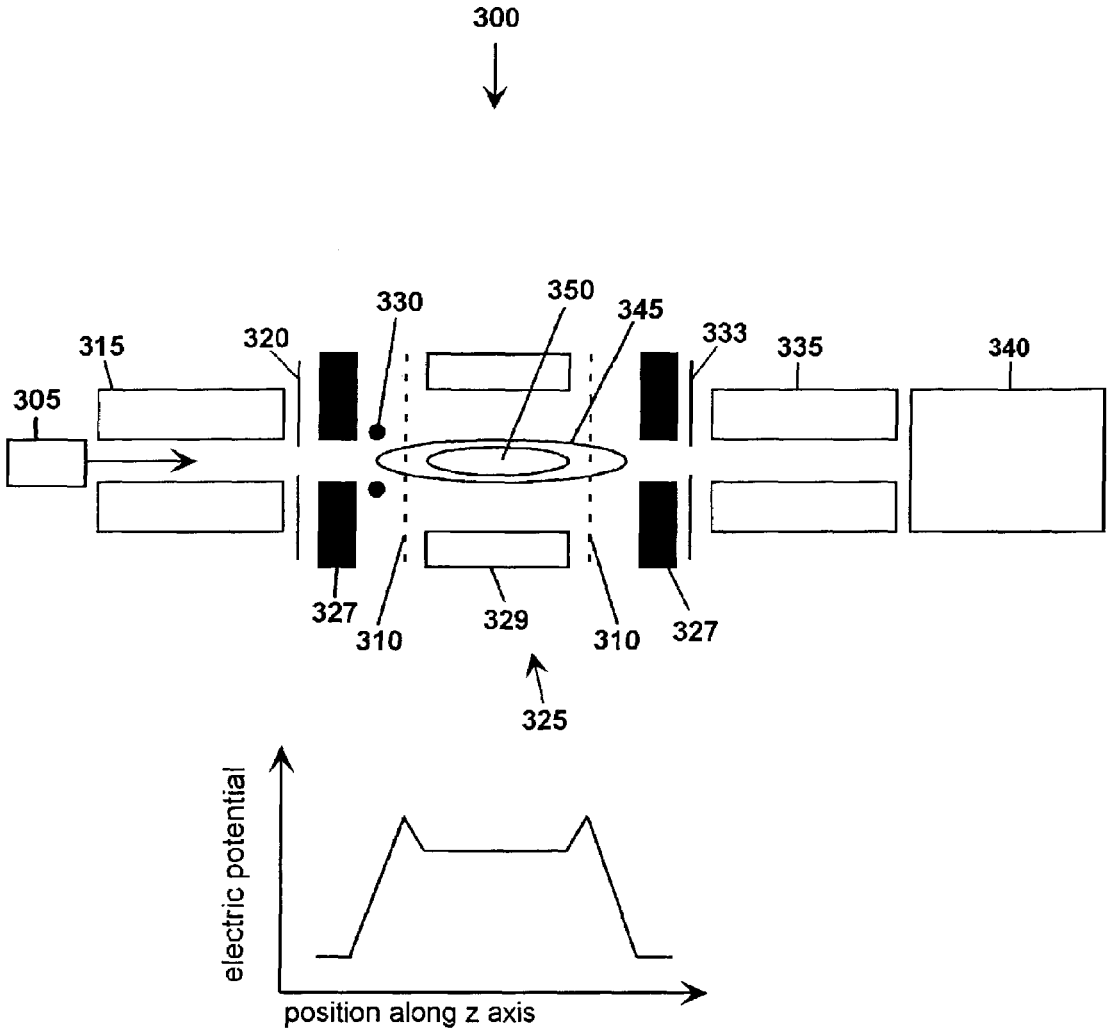
FIG. 7 illustrates an embodiment of a mass spectrometer according to the present invention with a magnetic trap and mesh trapping electrodes.

FIG. 7 illustrates a mass spectrometer 300 with additional trapping electrodes 310. The mass spectrometer 300 includes an ion source 305, a first mass analyzer 315 (e.g., a quadrupole mass analyzer), an ion gate 320, a magnetic trap 325 with magnetic end-cap electrodes 327 and a ring electrode 329, mesh electrodes 310, an electron source 330, another ion gate 333, a second mass analyzer 335 (e.g., a quadrupole mass analyzer), and a third mass analyzer 340 with a detector (e.g., a time-of-flight mass analyzer with a detector). As illustrated in FIG. 7, the magnetic trap 325 could be used in conjunction with the mesh trapping electrodes 310 to trap both electrons 345 and positive ions 350. FIG. 7 includes a graph of a possible electric potential along the z axis when both electrons 345 and positive ions 350 are confined in the magnetic trap 325 using the magnetic trap 325 and the additional trapping electrodes 310.

In operation of the mass spectrometer 300 of FIG. 7, ions are produced by ion source 305 and are injected into the first mass analyzer 315, which is used to select parent ions in a specified m/z range. The parent ions are injected into the magnetic trap 325 and confined. Either before, after, or during injection of the parent ions into the magnetic trap 325, electrons generated by electron source 330 are confined in the magnetic trap 325. After at least some of the parent ions react with the electrons 345 and undergo electron capture dissociation to produce product ions, the product ions and any remaining parent ions are ejected from the magnetic trap 325 into the second mass analyzer 335. The second mass analyzer 335 is used to inject the product ions to the third mass analyzer 340, which is used to produce a mass spectrum of the product ions. Although the mass spectrometer 300 is shown and described with respect to electron capture dissociation, the mass spectrometer could also be used for positron capture dissociation by confining both positrons and negative ions in magnetic trap 325.

In another aspect of the invention, electron (or positron) capture dissociation may be performed by confining ions to a region within a magnetic trap and passing electrons (or positrons) through the trap. When electron capture dissociation is to be performed, the ions are typically positive ions, and when positron capture dissociation is to be performed, the ions are typically negative ions. After electron (or positron) capture dissociation, the product ions may be ejected to a mass analyzer and analyzed outside of the magnetic trap. A mass spectrometer comprising a first analyzer, a magnetic trap, and a second analyzer as described above could be used for such electron (or positron) capture dissociation, with appropriate voltages and an appropriate magnetic field applied to the magnetic trap in order to trap ions rather than electrons (or positrons). After the ions are trapped in the magnetic trap, electrons (or positrons) from an appropriate source are directed through the magnetic trap (e.g., through one of the apertures of the end-cap electrodes) such that electron (or positron) capture dissociation of at least a some of the ions occurs.

Electron (or positron) capture dissociation in such a manner also provides methods of performing tandem mass spectrometry using a mass spectrometer as described above comprising a first mass analyzer, a magnet trap, and a second mass analyzer. Ions are generated using an ion source and are injected into the first mass analyzer. Parent ions to be subjected to electron (or positron) capture dissociation are selected using the first mass analyzer and are then injected into and confined within the magnetic trap. Electrons (or positrons) are provided (e.g., by an electron or positron source) and are injected into the magnetic trap for reaction with the confined ions. Electron (or positron) capture dissociation of at least some of the parent ions produces product ions, which are ejected from the trap into the second mass analyzer. The product ions are detected and a mass spectrum may be produced. As mentioned above, the charged particles (i.e., ions and electrons) are manipulated during the method using appropriate voltages and magnetic fields to the mass analyzers and magnetic trap.

In another aspect of the invention, electron (or positron) capture dissociation may be performed by passing ions through a region containing electrons (or positrons) (i.e., an electron (or positron) region). The region containing electrons (or positrons) is preferably a field-free region (i.e., a region with no electric or magnetic fields for trapping electrons or ions). When electron capture dissociation is to be performed, the ions are typically positive ions, and when positron capture dissociation is to be performed, the ions are typically negative ions. In addition, the ions are preferably multiply charged ions (i.e., the ions preferably have a charge state of 2 or more).

A mass spectrometer capable of performing electron (or positron) capture dissociation using such a method comprises a first mass analyzer, an electron (or positron) source, an electron (or positron) region (e.g., a field-free region), and a second mass analyzer. The mass spectrometer preferably includes means for creating a field-free region in order to create a field-free region for electrons (or positrons) from the electron (or positron) source. For example, the mass spectrometer may include two grounded electrodes in order to provide a field free region between the grounded electrodes. Such grounded electrodes could be, for example, plates with apertures that allow ions to pass through the field-free region or could be mesh electrodes that allow the passage of ions.

The first mass analyzer, the electron (or positron) source, the electron (or positron) region (e.g., the field-free region), and the second mass analyzer are arranged such that ions may move from the first mass analyzer through the region for containing electrons (or positrons) (e.g., the field-free region) to the second mass analyzer. That is, the first mass analyzer, the region for containing electrons (or positrons) (e.g., the field-free region), and the second mass analyzer are arranged in series (linear or otherwise). The electron (or positron) source is positioned such that electrons (or positrons) may be supplied to the electron (or positron) region (e.g., the field-free region) when desired.

The mass spectrometer may consist only of the first mass analyzer, the electron (or positron) source, the region for containing electrons (or positrons), and the second mass analyzer, or may include other elements. In one embodiment, the mass spectrometer does not include a magnetic trap.

The electron (or positron) source may be inside or outside of the electron (or positron) region as long as electrons (or positrons) for electron (or positron) capture dissociation may be supplied to the region when desired. Examples of electron sources include, but are not limited to, a thermal electron source (e.g., a tungsten filament or mesh) that may or may not be covered with a substance that provides a low work function (e.g., barium oxide (BaO)). In one embodiment, the electron source is a mesh electron source that allows the passage of ions through the mesh.

The mass spectrometer typically includes an ion source to supply ions to the first mass analyzer, although the ion source may be external to (i.e., not a part of) the mass spectrometer. Ions may be supplied using ion sources that use electrospray ionization (ESI), nanoelectrospray ionization (nESI), matrix assisted laser desorption ionization (MALDI), electron impact ionization (EI) or any other method for producing ions. The ion flow in the mass spectrometer is typically from an ion source to the first mass analyzer, from the first mass analyzer through the electron (or positron) region (e.g., a field free region) containing electrons (or positrons) to the second mass analyzer.

The first and second mass analyzers may be different types of mass analyzers or the same type of mass analyzer. For example, the first mass analyzer could be a quadrupole ion trap and the second mass analyzer could be a quadrupole mass filter, or both the first mass analyzer and the second mass analyzer could be quadrupole ion traps. The first mass analyzer and the second mass analyzer could be operated to sort, guide, trap, etc. ions in a broad mass-to-charge ratio (m/z) range or a narrow m/z range. In addition, one or more of the first mass analyzer, the electron (or positron) region (e.g., the field-free region), and the second mass analyzer may be positioned within one or more enclosures with pumps to provide operating conditions with reduced pressure (e.g., a vacuum).

Charged particles (e.g., ions) may be manipulated during operation of the mass spectrometer by modifying the electric fields of one or more of the mass analyzers or other elements of the mass spectrometer. Such manipulation may be associated with injecting, trapping, sorting, or ejecting ions from the first or second mass analyzers and/or reversing the ion flow from downstream to upstream and from upstream to downstream (e.g., to pass ions through the electron (or positron) region multiple times). Modification of the electric fields of one or more of the mass analyzers in order to manipulate charged particles in the mass spectrometer will depend on the specific mass analyzers being used with the mass spectrometer as well as the specific arrangement of the mass analyzers and any other elements of the mass spectrometer.

The present invention also includes methods of performing tandem mass spectrometry using a mass spectrometer as described above comprising a first mass analyzer, an electron (or positron) source, an electron (or positron) region (e.g., the field-free region), and a second mass analyzer. Ions are generated using an ion source and are injected into the first mass analyzer. Parent ions to be subjected to electron (or positron) capture dissociation are selected in the first mass spectrometer and are injected into the region containing electrons (or positrons) (e.g., a field-free region containing electrons or positrons). At least some of the parent ions react with the electrons (or positrons) in the electron (or positron) region and are dissociated into product ions via electron (or positron) capture dissociation. At least some of the product ions pass into the second mass analyzer and may be detected using a detector of the second (or another) mass analyzer. When the electron (or positron) region is a field-free region (i.e., when the mass spectrometer further comprises means for creating a field free region between the first and second mass analyzers), the parent ions must have sufficient kinetic energy to enter the field free region and react with the electrons (or positrons) therein, and the product ions must have sufficient kinetic energy formed by electron capture dissociation to reach the second mass analyzer once they are formed.

Figure 8:
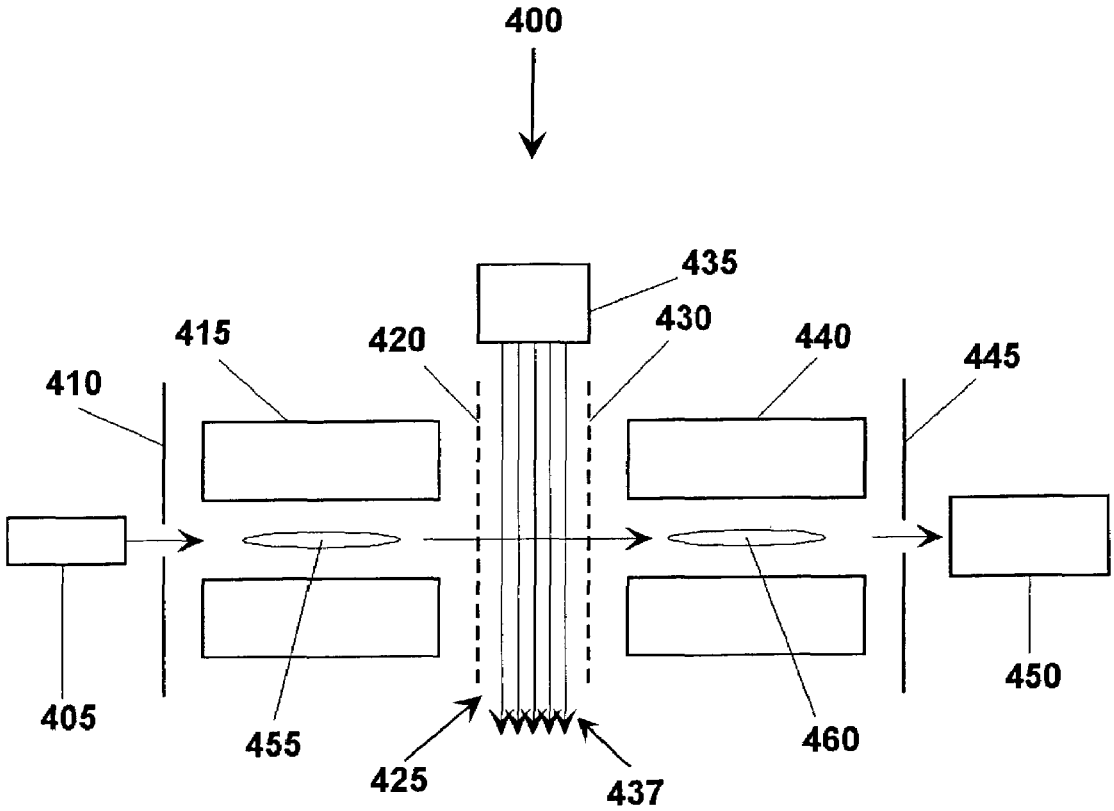
FIG. 8 illustrates an embodiment of a mass spectrometer according to the present invention with a field-free region.
Figure 9:
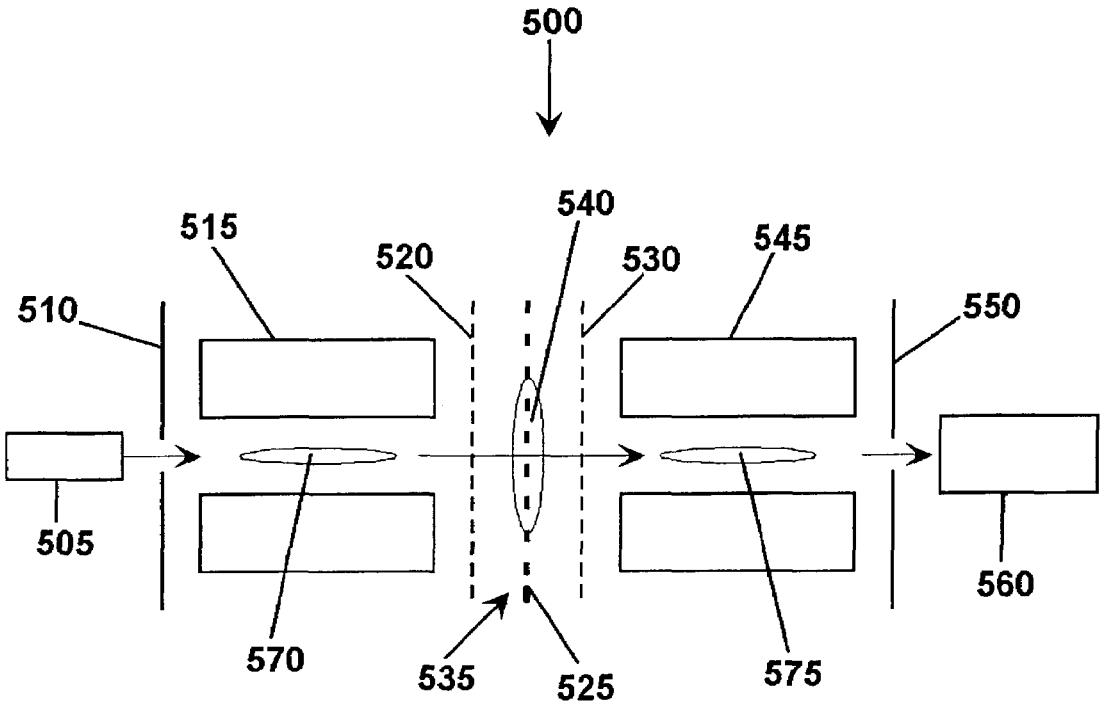
FIG. 9 illustrates another embodiment of a mass spectrometer according to the present invention with a field-free region.

Examples of mass spectrometers capable of performing electron (or positron) capture dissociation (and tandem mass spectrometry) by passing ions through a field-free region are illustrated in FIGS. 8 and 9. The mass spectrometer 400 illustrated in FIG. 8 includes an ion source 405, a first ion gate 410, a first mass analyzer 415, mesh electrodes 420 and 430, an electron (or positron) source 435, a field-free region 425, a second mass analyzer 440, a second ion gate 445, and a third mass analyzer 450 with a detector. In operation of the mass spectrometer 400, ions generated by ion source 405 are injected through ion gate 410 into the first mass analyzer 415, where parent ions 455 having a specified m/z range are selected for electron (or positron) capture dissociation. The mesh electrodes 420 and 430 are used to create a field-free region 425 (e.g., by grounding the mesh electrodes 420 and 430). Electrons (or positrons) 437 from the electron (or positron) source 435 are passed through the field-free region 425. The parent ions 455 selected by the first mass analyzer are passed through the field-free region 425 for reaction with the electrons (or positrons) 437. At least some of the parent ions 455 react with the electrons (or positrons) 437 in the field-free region 425 and are dissociated into product ions via electron (or positron) capture dissociation. At least some of the product ions pass into the second mass analyzer 440, which is used to select and/or guide product ions 460. The product ions 460 are passed through ion gate 445 and are analyzed by the third mass analyzer 450 to produce a mass spectrum (not shown). The movement of the ions through the mass spectrometer is shown by the horizontal arrows along the z axis.

FIG. 9 illustrates another mass spectrometer 500 capable of performing electron capture dissociation (and tandem mass spectrometry) by passing ions through a field-free region. The mass spectrometer 500 includes an ion source 505, a first ion gate 510, a first mass analyzer 515, mesh electrodes 520 and 530, a mesh electron source 525 (e.g., a tungsten mesh plated with BaO), a field-free region 535, a second mass analyzer 545, a second ion gate 550, and a third mass analyzer 560 with a detector. In operation of the mass spectrometer 500, ions generated by the ion source 505 are injected through ion gate 510 into the first mass analyzer 515, where parent ions 570 having a specified m/z range are selected for electron capture dissociation. The mesh electrodes 520 and 530 are used to create a field-free region 535. Electrons 540 are generated by the mesh electron source 525 in the field-free region 535. The parent ions 570 selected by the first mass analyzer 515 are passed through the field-free region 535 for reaction with the electrons 540. At least some of the parent ions 570 react with the electrons 540 in the field-free region 535 and are dissociated into product ions via electron capture dissociation. At least some of the product ions pass into the second mass analyzer 545, which is used to select and/or guide product ions 575. The product ions 575 are passed through ion gate 550 into the third mass analyzer 560 for analysis and production of a mass spectrum. The movement of the ions through the mass spectrometer 500 is shown by the horizontal arrows along the z axis.

While the invention has been described in detail and with reference to specific embodiments thereof, it will be apparent to one skilled in the art that various changes and modifications can be made without departing from the spirit and scope of the invention.

The invention claimed is:

1. A mass spectrometer comprising:

a first mass analyzer;

a magnetic trap downstream of the first mass analyzer to trap charged particles using a static electric field and a static magnetic field, wherein the magnetic trap has permanent magnet end cap electrodes;

a second mass analyzer downstream of the magnetic trap; and an electron or positron source positioned such that electrons or positrons may be supplied to the magnetic trap.

2. The mass spectrometer of claim 1 wherein one or both of the first and second mass analyzers include a detector.

3. The mass spectrometer of claim 1 further comprising an ion source.

4. The mass spectrometer of claim 3 wherein the ion source is an electrospray ionization source, a nanoelectrospray ionization source, or a matrix assisted laser desorption ionization source.

5. The mass spectrometer of claim 1 wherein the first mass analyzer is a time-of-flight mass analyzer, a quadrupole mass filter, or a quadrupole ion trap.

6. The mass spectrometer of claim 1 wherein the first mass analyzer is a linear radio frequency quadrupole mass analyzer.

7. The mass spectrometer of claim 6 wherein the linear radio frequency quadrupole mass analyzer is a quadrupole mass filter or a quadrupole ion trap.

8. The mass spectrometer of claim 1 wherein the second mass analyzer is a time-of-flight mass analyzer, a quadrupole mass filter, or a quadrupole ion trap.

9. The mass spectrometer of claim 1 wherein the second mass analyzer is a linear radio frequency quadrupole mass analyzer.

10. The mass spectrometer of claim 9 wherein the linear radio frequency quadrupole mass analyzer is a quadrupole mass filter or a quadrupole ion trap.

11. The mass spectrometer of claim 1 wherein the magnetic trap is an ideal Penning trap.

12. The mass spectrometer of claim 1 wherein the first mass analyzer is a linear radio frequency quadrupole mass analyzer and the second mass analyzer is a linear radio frequency quadrupole mass analyzer.

13. The mass spectrometer of claim 1 further comprising a third mass analyzer downstream of the second mass analyzer.

14. The mass spectrometer of claim 13 wherein the third mass analyzer is a time-of-flight mass analyzer.

15. The mass spectrometer of claim 1 further comprising an ion source and wherein the first mass analyzer is a linear radio frequency quadrupole mass analyzer and the second mass analyzer is a linear radio frequency quadrupole mass analyzer.

16. The mass spectrometer of claim 15 further comprising a third mass analyzer downstream of the second mass analyzer.

17. The mass spectrometer of claim 16 wherein the third mass analyzer is a time-of-flight mass analyzer.

18. A mass spectrometer of claim 1, wherein the magnetic trap has a magnetic field strength larger than 0.5 Tesla.

19. The mass spectrometer of claim 1, wherein the electron source is selected from the group consisting of a thermal and a mesh electron source.

20. The mass spectrometer of claim 1, wherein the first and second mass analyzers are selected from the group consisting of magnetic sectors, linear and three-dimensional quadrupoles, other multipole analyzers, and time-of-flight mass analyzers.

21. The mass spectrometer of claim 1, wherein the magnetic trap further comprises a ring electrode.

22. The mass spectrometer of claim 1, wherein the magnetic trap has a magnetic field strength of 1.3 T or larger.

23. A mass spectrometer comprising:

a first mass analyzer;

a magnetic trap downstream of the first mass analyzer to trap charged particles using a static electric field and a static magnetic field, wherein the magnetic trap has permanent magnet end cap electrodes;

a second mass analyzer downstream of the magnetic trap;

an electron or positron source positioned such that electrons or positrons may be supplied to the magnetic trap; and two additional trapping electrodes, one of the additional trapping electrodes positioned between the first mass analyzer and the magnetic trap and the other additional trapping electrode positioned between the second mass analyzer and the magnetic trap.

24. A method of performing electron capture dissociation of ions comprising:

(a) generating electrons using an electron source;

(b) confining the electrons to a region within a magnetic trap, wherein the magnetic trap uses a static electric field and a static magnetic field to trap charged particles, further wherein the magnetic trap has permanent magnet end cap electrodes; and (c) injecting positive ions into the magnetic trap such that electron capture dissociation of at least some of the ions occurs.

25. A method of performing positron capture dissociation of ions comprising:

(a) generating positrons using a positron source;

(b) confining the positrons to a region within a magnetic trap, wherein the magnetic trap uses a static electric field and a static magnetic field to trap charged particles, further wherein the magnetic trap has permanent magnet end cap electrodes; and (c) injecting negative ions into the magnetic trap such that positron capture dissociation of at least some of the ions occurs.

26. A method of performing tandem mass spectrometry using a mass spectrometer comprising a first mass analyzer, a magnetic trap, and a second mass analyzer, the method comprising:

(a) generating positive sample ions using an ion source;

(b) injecting the sample ions into the first mass analyzer;

(c) using the first mass analyzer, selecting parent ions from the sample ions to be subjected to electron capture dissociation;

(d) injecting the parent ions into the magnetic trap for reaction with electrons confined in the magnetic trap such that electron capture dissociation of at least some of the parent ions occurs to produce product ions, wherein the magnetic trap uses a static electric field and a static magnetic field to trap charged particles, further wherein the magnetic trap has permanent magnet end cap electrodes;

(e) ejecting the product ions from the magnetic trap into the second mass analyzer; and (f) detecting the product ions using the second mass analyzer.

27. The method of claim 26, wherein the first mass analyzer comprises a linear radio frequency quadrupole mass analyzer and the second mass analyzer comprises a linear radio frequency quadruple mass analyzer.

28. A method of performing tandem mass spectrometry using a mass spectrometer comprising a first mass analyzer, a magnetic trap, and a second mass analyzer, the method comprising:

(a) generating negative sample ions using an ion source;

(b) injecting the sample ions into the first mass analyzer;

(c) using the first mass analyzer, selecting parent ions from the sample ions to be subjected to positron capture dissociation;

(d) injecting the parent ions into the magnetic trap for reaction with positrons confined in the magnetic trap such that positron capture dissociation of at least some of the parent ions occurs to produce product ions, wherein the magnetic trap uses a static electric field and a static magnetic field to trap charged particles, further wherein the magnetic trap has permanent magnet end cap electrodes;

(e) ejecting the product ions from the magnetic trap into the second mass analyzer; and (f) detecting the product ions using the second mass analyzer.

29. The method of claim 28, wherein the first mass analyzer comprises a linear radio frequency quadrupole mass analyzer and the second mass analyzer comprises a linear radio frequency quadrupole mass analyzer.

30. A method of performing tandem mass spectrometry using a mass spectrometer comprising a first mass analyzer, a magnetic trap, and a second mass analyzer, the method comprising:

(a) generating positive sample ions using an ion source;

(b) injecting the sample ions into the first mass analyzer;

(c) using the first mass analyzer, selecting parent ions from the sample ions to be subjected to electron capture dissociation;

(d) injecting and confining the parent ions in the magnetic trap, wherein the magnetic trap uses a static electric field and a static magnetic field to trap charged particles, further wherein the magnetic trap has permanent magnet end cap electrodes;

(e) injecting electrons into the magnetic trap for reaction with the confined parent ions such that electron capture dissociation of at least some of the parent ions occurs to produce product ions;

(f) ejecting the product ions from the magnetic trap into the second mass analyzer; and (g) detecting the product ions using the second mass analyzer.

31. A method of performing tandem mass spectrometry using a mass spectrometer comprising a first mass analyzer, a magnetic trap, and a second mass analyzer, the method comprising:

(a) generating negative sample ions using an ion source;

(b) injecting the sample ions into the first mass analyzer;

(c) using the first mass analyzer, selecting parent ions from the sample ions to be subjected to positron capture dissociation;

(d) injecting and confining the parent ions in the magnetic trap, wherein the magnetic trap uses a static electric field and a static magnetic field to trap charged particles, further wherein the magnetic trap has permanent magnet end cap electrodes;

(e) injecting positrons into the magnetic trap for reaction with the confined parent ions such that positron capture dissociation of at least some of the parent ions occurs to produce product ions;

(f) ejecting the product ions from the magnetic trap into the second mass analyzer; and (g) detecting the product ions using the second mass analyzer.

32. A mass spectrometer comprising:

a first mass analyzer;

a field-free region downstream from the first mass analyzer;

an electron or positron source positioned such that electrons or positrons may be supplied to the field-free region; and a second mass analyzer downstream of the field-free region, wherein the electron source is a mesh electron source positioned in the field-free region.

33. A method of performing tandem mass spectrometry using a mass spectrometer comprising a first mass analyzer, a field-free region, an electron source, and a second mass analyzer, the method comprising:

(a) generating positive sample ions using an ion source;

(b) injecting the sample ions into the first mass analyzer;

(c) using the first mass analyzer, selecting parent ions from the sample ions to be subjected to electron capture dissociation;

(d) providing electrons in the field-free region using the electron source;

(e) injecting the parent ions into the field-free region such that electron capture dissociation of at least some of the product ions occurs and such that at least some of the product ions pass into the second mass analyzer; and (f) detecting the product ions using the second mass analyzer, wherein the electron source is a mesh electron source positioned in the field-free region.

* * * * *